US005486156A

United States Patent [19]

Takach

[11] Patent Number: 5,486,156

[45] Date of Patent: Jan. 23, 1996

[54] HEAD VIBRATOR

[76] Inventor: Stephen J. Takach, 3 Durban Ave., Hopatcong, N.J. 07843

[21] Appl. No.: 192,621

[22] Filed: Feb. 7, 1994

[51] Int. Cl.[6] ..... A61H 1/00

[52] U.S. Cl. ..... 601/70; 601/46; 601/58

[58] Field of Search ..... 601/46, 67, 69–72, 601/75, 78, 79, 56, 61, 65, 58; 602/74; 600/26, 27

[56] References Cited

U.S. PATENT DOCUMENTS

| | | | |
|---|---|---|---|
| Re. 19,256 | 5/1930 | Karlström | 601/75 |
| 3,557,781 | 1/1971 | Kaye | 601/71 |
| 3,763,853 | 10/1973 | Jochiminski | 601/70 |
| 3,878,838 | 4/1975 | Lunn | 601/71 |
| 4,052,981 | 10/1977 | Bachmann | 601/71 |
| 4,178,923 | 12/1979 | Curlee | 128/DIG. 20 |
| 4,469,092 | 9/1984 | Marshall | 601/70 |
| 4,732,140 | 3/1988 | Stoffregen | 601/46 |
| 4,920,466 | 4/1990 | Liu | 601/46 |
| 4,979,502 | 12/1990 | Hunt | 601/79 |
| 5,245,989 | 9/1993 | Simon | 601/108 |

FOREIGN PATENT DOCUMENTS

| | | | |
|---|---|---|---|
| 1092977 | 4/1955 | France | 601/46 |

*Primary Examiner*—Robert A. Hafer
*Assistant Examiner*—David J. Kenealy
*Attorney, Agent, or Firm*—Terrance L. Siemens

[57] ABSTRACT

Briefly, the invention is a vibrating, form fitting skull cap which is designed to snugly fit a user. The inner portion of the cap presents a smooth continuous surface to the head while at the same time providing the capability of complex and subtle vibration patterns which may vibrate different areas differently. Suitable attachment points are provided on the outer portion of the cap to mount individual forced vibration generator units. Each vibration generator unit is separately controlled as to amplitude and frequency. The user may choose one or many of numerous available attachment points for the generators. Electrical controls are provided to fine tune the individual units. Numerous electrical power input alternatives are provided for flexibility of use. Pneumatic powered units may also be used to eliminate magnetic fields if necessary.

9 Claims, 3 Drawing Sheets

HEAD VIBRATOR

BACKGROUND OF THE INVENTION

1. Field of the Invention

The present invention relates to therapeutic devices for the relief of pain. More specifically, it relates to a massage device capable of multiple frequencies and amplitudes. Even more specifically, the device relates to a head vibrator device for the relief of headaches and similar neurological disorders in the area of the head and neck.

2. Description of the Prior Art

The prior art has recognized many of the benefits gained by the application of vibratory displacements to various areas of the human body. Massaging devices, in general, are old and well known. The common benefits of massage on muscular tissue are old and well documented. However massaging devices for the head area are less common and the benefits less well understood. As will be seen, my invention provides a new and beneficial form of vibratory input to the head area which I have found to be particularly useful in providing relaxation and relief from pain. Scalp massage is a well known form of invigoration known to barbers for centuries. My invention, however, is primarily designed to vibrate not only the scalp but the underlying structure of the skull and brain as well. The instant invention can relieve tension, stress, and pain from the entire body because pain is perceived in the brain.

During a search in this art area, a number of relevant patents were uncovered and they will be discussed hereinafter. As will be seen, the simplicity and effectiveness of my invention is not rivaled in the prior art.

U.S. Pat. No. 3,763,853, issued to Jochimski on Oct. 9, 1973, shows a head vibrator having a plurality of head massaging fingers pressing against the skull of the user. All the fingers are driven by a single vibratory source and are thus all driven at a common frequency. By contrast, the device of the instant invention provides a number of options for vibrating the head which may not be achieved with the device of Jochimski. My device presents a single smooth surface to the head. Also, my device uses multiple sources of vibrations that can be tuned to different frequencies and amplitudes as desired. This widely expands the possible treatments and benefits that can be Gleaned from my device as well as significantly reducing the cost.

U.S. Pat. No. 4,469,092, issued to Marshall et al. on Sep. 4, 1984, shows a scalp stimulating system. The system includes an internal pad with numerous tiny fingers driven by a single vibratory source. By contrast, the device of the instant invention presents a single smooth surface to the head which is capable of complex and subtle vibratory action.

U.S. Pat. No. 3,478,736, issued to Roberts et al. on Nov. 18, 1969, shows a device for massaging the temple areas of the scalp. By contrast, the device of the instant invention may simultaneously massage the temples neck and other areas of the head with vibrations of differing frequency and amplitude, allowing beats to pulsate the entire head, neck, jaw, and face.

U.S. Pat. No. 5,115,769, issued to Fiorini on May 26, 1992, shows another form of temple massager. The device is designed to primarily provide single frequency vibrations in a direction parallel to the skull thus providing a skin massaging action at the temple areas. By contrast, the device of the instant invention will provide multiple frequency vibrations to the entire head in all directions.

It will be noted that all the prior art devices utilize a single forced vibration source. By necessity, this limits them to the application of a single frequency of vibration in a single direction at a fixed amplitude. This severely limits the potential benefits of the vibrations. For example the vibration of the brain in the skull cavity depends upon the mass of the brain and the resilience of its connective tissue which varies from person to person. If one of these single frequency prior art devices were ideal for one particular person it would likely not work for another person. My device provides for multiple amplitudes used with separately adjustable frequencies. This allows the rythyms of the beats, created by slightly differing frequencies, to be used as a mild to vigorous massaging stimulant transmitted throughout the entire helmet. The flexibility and adjustability of the instant invention allows for anyone to find the settings that will afford them the most benefit.

None of the above inventions and patents, taken either singly or in combination, is seen to describe the instant invention as claimed.

SUMMARY OF THE INVENTION

Briefly, the invention comprises a form fitting cap snugly fitting the skull of the user. The inner portion of the cap presents a smooth continuous surface to the head while at the same time providing the capability of complex and subtle vibration patterns which may vibrate different areas differently. Suitable attachment points are provided on the outer portion of the cap to mount individual forced vibration generator units. Each vibration generator unit is separately controlled as to amplitude and frequency. The user may choose one or many of numerous available attachment points for the generators. Electrical control means are provided to fine tune the individual units. Numerous electrical power input alternatives are provided for flexibility of use. Pneumatic powered units may also be used to eliminate magnetic fields if necessary.

Accordingly, it is a principal object of the invention to provide a new and improved head vibrator device which overcomes the disadvantages of the prior art in a simple but effective manner.

It is a major object of this invention to provide a new and improved head vibrator with numerous, finely tuned, infinitely adjustable, and flexibly combinable forced vibration generator units.

It is another object of the invention to provide a new and improved head vibrator with a form-fitting skull cap that has no interior protrusions to cause injury or discomfort.

It is another object of the invention to provide a new and improved head vibrator with numerous mounting locations for one or more of the independently controllable forced vibration generator units.

It is another object of the invention to provide a new and improved head vibrator with each of the independently controllable forced vibration generator units being assembled in protective pods.

It is another object of the invention to provide a new and improved head vibrator with each of the independently controllable forced vibration generator units being adjustable in amplitude.

It is another object of the invention to provide a new and improved head vibrator with each of the independently controllable forced vibration generator units being adjustable in frequency.

It is yet another object of the invention to provide a new and improved head vibrator unit with built-in heating elements.

Finally, it is a general goal of the invention to provide improved elements and arrangements thereof in an apparatus for the purposes described which is inexpensive, dependable and fully effective in accomplishing its intended purposes.

The present invention meets or exceeds all the above objects and goals. Upon further study of the specification and appended claims, further objects and advantages of this invention will become apparent to those skilled in the art.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
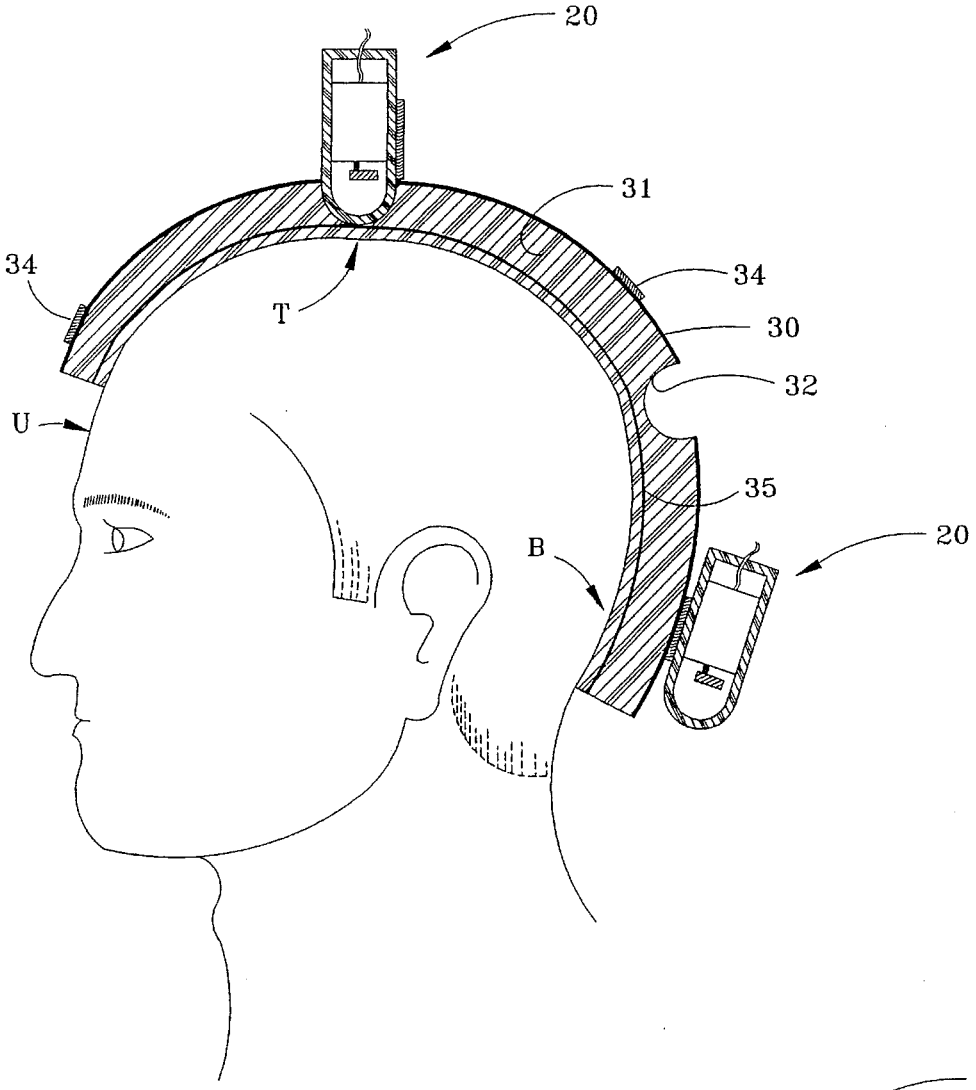
FIG. 1 is a cross sectional side view of the invention shown mounted to the head of a user.
Figure 3:
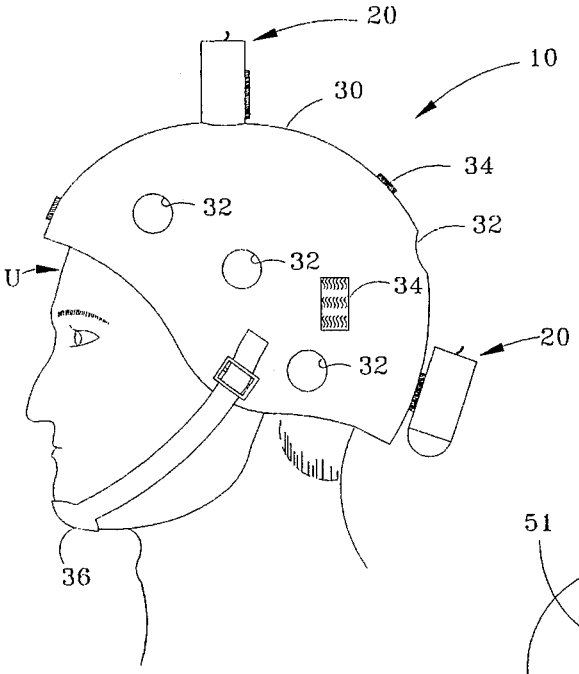
FIG. 3 is a side view of the invention mounted to the head of a user showing a chin strap for snug fitting.

FIGS. 1 and 3 show the invention 10 mounted on the head of a user U. A generally snug-fitting foam-like cap is made up of a vinyl coating 30 covering a thick foam interior portion 31. The portion of interior portion 31 that is exposed to the user is smooth for ease of use and safety. The outer surface 30 is perforated with a series of dimples or pockets 32 for mounting vibrator units 20 as more fully described later. As is clear from FIG. 1, vibrator units 20 do not interfere with the smooth interior surface of foam 31. Of course, it will be obvious to the artisan that foam rubber coated with vinyl is but one of many possible choices of material that are possible. The actual material chosen must be pliable so as to fit various sized skulls, easy to clean, durable, and capable of transmitting vibrations in the manner hereafter described.

FIG. 1 shows schematically an imbedded heating wire 35 which optionally may be used to apply heat, as well as vibration to the head of a user. Details of the heating wire are well within the level of ordinary skill in the art and are not further elaborated upon here. Note that the cap extends fully over the top T and back B of the head as well as down around the temple areas and the ears. It is contemplated that holes could be formed in the cap if, for example, it were desired to leave the ears exposed. Also, the extent of the cap could be broadened so as to fully cover the neck, portions of the shoulders, the forehead, or even the face. Such minor design variations are to be considered within the scope of the appended claims.

Strategically located around the outer surface of the helmet are patches of an artificial briar material such as VELCRO. These patches are mated with complementary patches on the vibrator units described later. As shown in FIG. 3, a chin strap 36 may be used to hold the cap firmly on the head during use. It is contemplated that the cap material should be elastic enough to stretch to fit several different sizes. When the size of the cap is a little too large to stretch firmly over the head of the user, the chin strap will serve a snuggling function. It is also noted that the chin strap will serve to transmit vibrations of the skull cap through the jaw bone to the sinus cavities. Thus it is anticipated that chin strap 36 may have therapeutic as well as support functions. It is also contemplated that for extra ordinary situations, the cap may be an enlarged or smaller version.

Figure 2:
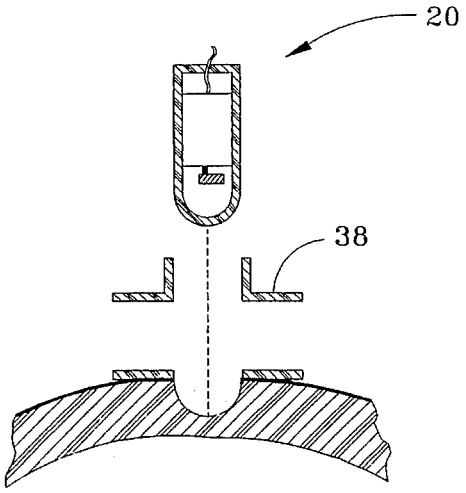
FIG. 2 is a partial cross-sectional view of one form of the mounting arrangements for the vibrator units.

Another form of housing for vibrator units 20 is shown in FIG. 2. Here a conventional PVC "T" pipe fitting 38 has been adapted for housing the vibrator units 20 and for smooth sideways mounting to the cap. The "T" fitting allows for mounting of units 20 sideways by using the other openings in the fitting. The actual attachment of "T" 38 to the cap may be by artificial briar material, adhesive tape, the "T" fitting snug in one of the pockets, or any other conventional means.

Figure 5:
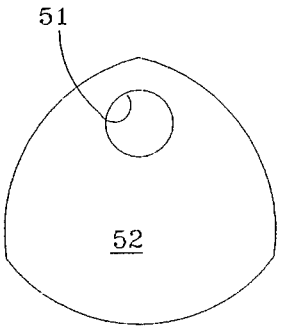
FIG. 5 is an end view of another form of eccentric weight used in the vibrator units.
Figure 4:
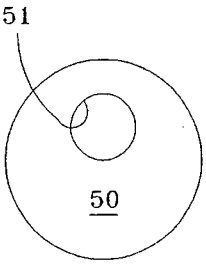
FIG. 4 is an end view of one form of an eccentric weight used in the vibrator units.
Figure 6:
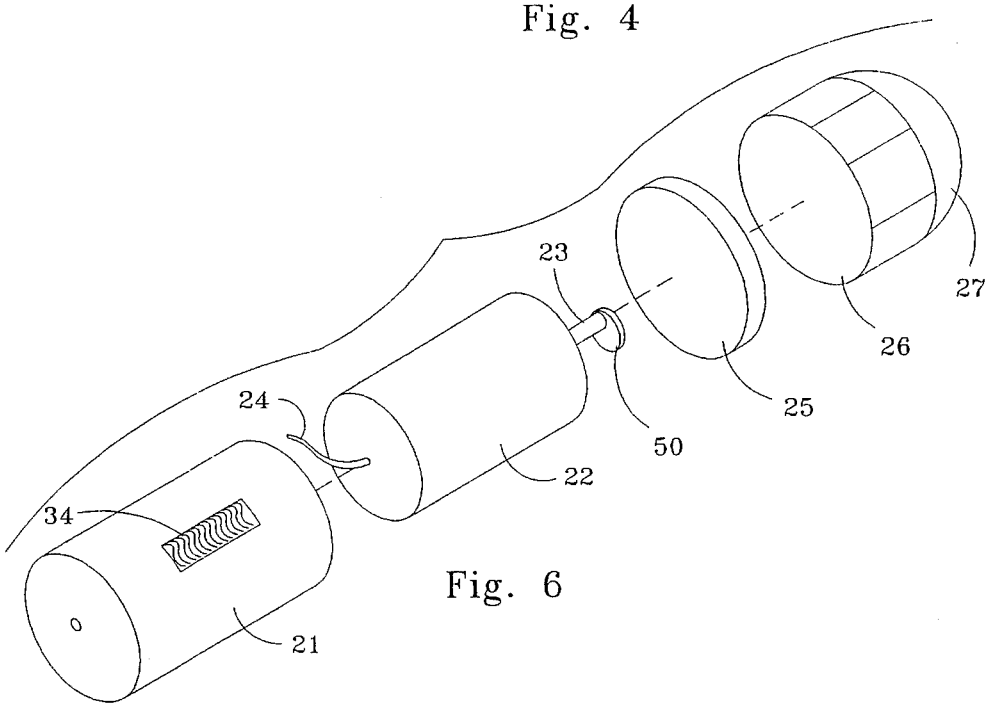
FIG. 6 is an exploded assembly view of the various parts of the vibrator unit.

Turning now to FIG. 6 the vibrator unit modules 20 will be described. Each module includes a variable speed DC motor 22 with a shaft 23 upon which are mounted eccentric weights such as 50. Motors 22 may also be variable speed air motors. When the motor is caused to turn the eccentric weights will cause an oscillatory centrifugal force to be generated. When the oscillatory force acts upon a resilient mount, such as the cap of this invention, a vibrational force will be transmitted through to the support surface of the mount, in this case the head of the wearer. The transmitted vibration will be at the same frequency as the rotational speed of the motor. Therefore the vibration frequency can be controlled by simply controlling the speed of the DC motors in a conventional manner. It is contemplated that the vibration amplitude can be controlled by providing different shaped and sized eccentric weights as 50 and 51 shown in FIGS. 4 and 5, respectively. It is contemplated that two thin weights such as 50 could be mounted longitudinally on motor shaft 23. If the two weights were rotated with respect to one another on the shaft, the net imbalance would be adjusted and this, in turn, would provide an adjustment of vibration amplitude.

Each of the motors 22 are enclosed in an outer plastic case 21 to provide both protection and electrical isolation. The outer plastic case 21 resembles a standard film canister familiar to everyone. A case cap 25 is provided to seal the motor in the case 21. Case cap 25 is adapted at its outer end to provide a mounting for portion 26 of dome 27. Dome 27 is fashioned so as to fit snugly in one of the depressions or dimples 32 of the cap 30. It is anticipated that the natural resiliency of the rubber foam 31 of the cap should be sufficient to spread around the dome end 27 of the vibrator unit to allow it to be easily inserted and yet firmly held. Of course, all sorts of other attachment means could be incorporated if needed. The dome in the dimple vibrator mounting, thus far described, is useful primarily for generating vibrations tangential to the surface of the skull. The following paragraph describes mounting means which are useful for generating vibrations normal to the surface of the skull.

Sideways mounting means are provided for vibrator units 20 in the form of artificial briar material 34 on the cap 30 and the side of motor case 21 as previously mentioned. When the vibrator units are so mounted, the primary direction of the oscillatory forces will be normal to the skull of the user. This arrangement allows turning the vibrator units through a full range of 360 degrees to further tune the composite pulsations being created by the multiple units. It is contemplated that some of the vibrator units could be mounted sideways while others are mounted vertically so as to provide complex combined motions to the skull cap. Further variation and complexity could be added by separately controlling the individual frequencies and amplitudes of the vibrations as discussed above. Since each vibratory unit is connected to the unitary resilient skull cap and the units are not necessarily forcing the same frequencies, it is interesting to note how the cap actually vibrates. My tests have shown that beats, overtones, and other phenomena normally associated with musical vibrations, are possible. This range of vibrational inputs to the head of a user has never been possible prior to my invention. The benefits and potential uses are thus largely unknown but now open to research and exploration.

Figure 7:
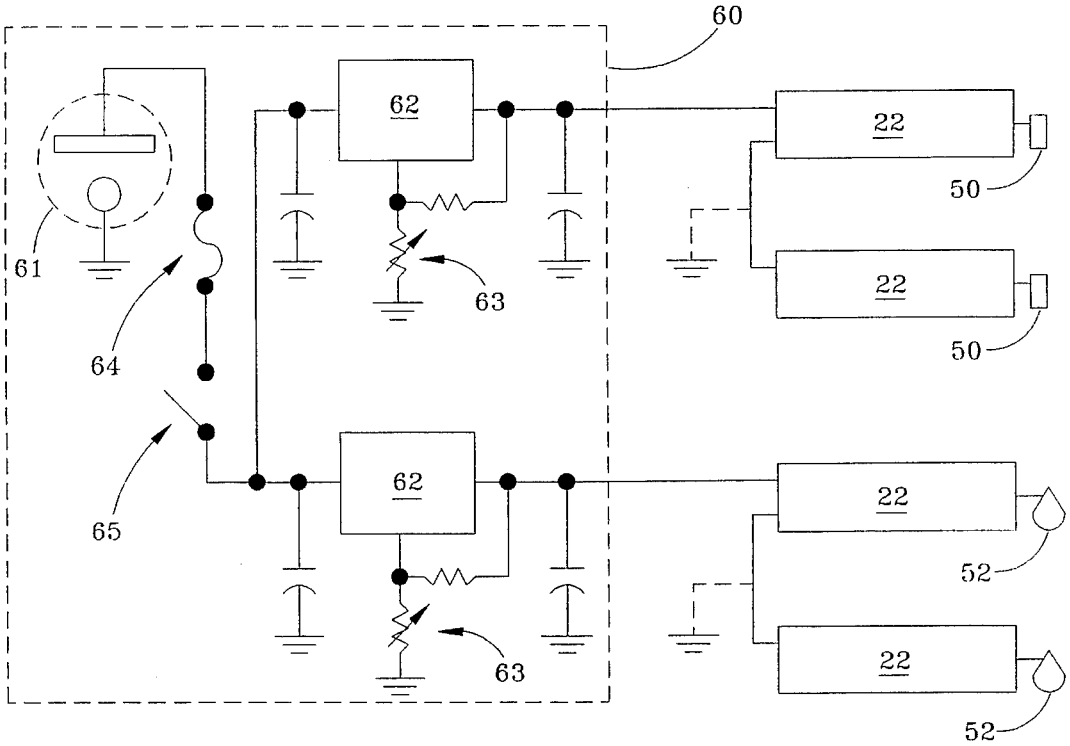
FIG. 7 is a schematic circuit diagram of the vibrator motor control means.

FIG. 7 shows a simple electrical schematic suitable for controlling multiple variable speed DC motors as is contemplated by this invention. Electrical input plug 61 passes current through fuse 64 and master on-off switch 65. It is important that the circuitry be adequately fused because of the close proximity of the motors to the head of a user. After main switch 65 are arranged two LM 150 variable speed controllers 62 in parallel with one another. The variable resistors 63 can be used to control the speed. Suitable external control knobs (not shown) could be used to operate the variable resistors. The output of each controller 62 is passed to a series of motors 22 with eccentric weights 50 or 52 as previously described. Both the input and output of controllers 62 are shunted to ground through capacitors so as to prevent the passage of any high frequency spurious voltage peaks.

Figure 8:
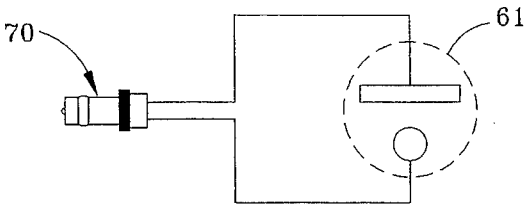
FIGS. 8, 9, and 10 show alternate electrical power inputs.
Figure 9:
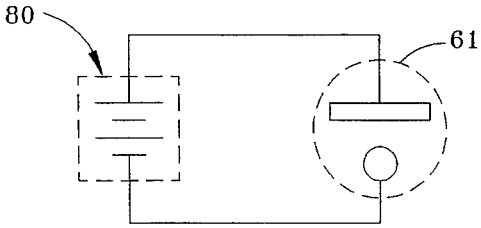
Figure 10:
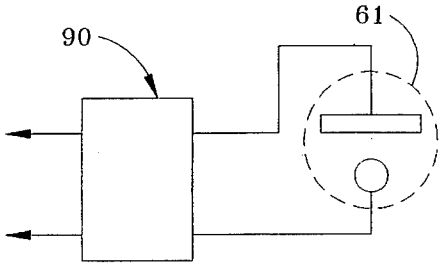

FIG. 8 shows one form of electrical power supply for the invention. Plug 61 may be connected to an automotive power supply by means of cigarette lighter plug 70. FIG. 9 shows another form of electrical power supply. Plug 61 is shown connected to a battery 80. Battery 80 may be a group of dry cells connected in series or parallel to provide the desired voltage and current characteristics. FIG. 10 shows another form of electrical power supply. Plug 61 is connected to a standard AC adaptor which will convert standard household alternating current to direct current at a reduced voltage as required for operation of the vibrator unit motors.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily design more or fewer attachments of various types for vibrator units. Also, man, forms and thicknesses of the encircling vibrating pad are possible depending on the particular body area to be massaged by the device.

It is to be understood that the present invention is not limited to the sole embodiment described above, but encompasses any and all embodiments within the scope of the following claims:

I claim:

1. A vibrating body massage unit comprising;

a unitary pad means for snugly fitting about an area of a user's body, said pad means having a smooth unbroken surface facing the user and comprising a pliable material firmly fitting around a body portion of the user wherein said smooth unbroken surface is a coated rubber-like foam material;

multiple vibration generation means with each generation means including control means; and attachment means on both said pad means and said vibration generation means for detachably connecting each of said vibration means to said pad means;

said attachment means including means for selectively attaching each of the vibration generation means at a plurality of different locations on the outside of said pliable material said means for selectively attaching comprising depressions in an outer surface of said pliable material and protrusions on said vibration generation means for detachably interconnecting with said depressions; whereby said control means on each of said vibration generation means enables a user to predetermine the frequency and the amplitude of each said vibration generation means such that a beat is generated within the user's body corresponding to the differences between the various predetermined frequencies produced by said multiple vibration generation means.

2. The vibrating body massage unit of claim 1 further comprising;

electrical power means for powering said vibration generation means.

3. The vibrating body massage unit of claim 2 wherein said electrical power means comprises a connection to an automotive battery.

4. The vibrating body massage unit of claim 2 wherein said electrical power means comprises a connection to a dry cell battery.

5. The vibrating body massage unit of claim 2 wherein said electrical power means comprises an alternating current adaptor connected to standard household electrical power.

6. The vibrating body massage unit of claim 1 wherein each said vibration generation means comprises;

a variable speed direct current motor with an output shaft;

eccentric weights mounted to said output shaft;

housing means for enclosing and firmly mounting said motor so as to transmit the vibrations generated by rotating said motor, shaft, and eccentric weights to said pad means and thus to said user.

7. The vibrating body massage unit of claim 6 wherein said control means comprises;

electrical means including a switch and a fuse for controlling the speed of each of said variable speed direct current motors; and means for varying the eccentricity of said eccentric weights.

8. A vibrating body massage unit comprising;

a unitary pad means for snugly fitting about an area of a user's body, said pad means having a smooth unbroken surface facing the user, and comprising a pliable skull cap firmly fitting around the head of the user wherein said smooth unbroken surface is a coated rubber-like foam material;

multiple vibration generation means with each generation means including control means; and attachment means on both said pad means and said vibration generation means for detachably connecting each of said vibration means to said pad means;

said attachment means including means for selectively attaching each of the vibration generation means at a plurality of different locations on the outside of said skull cap;

said means for selectively attaching comprising depressions in an outer surface of said pliable material and protrusions on said vibration generation means for detachably interconnecting with said depressions; whereby said control means on each of said vibration generation means enables a user to predetermine the frequency and the amplitude of each said vibration generation means such that a beat is generated within the user's body corresponding to the differences between the various predetermined frequencies produced by said multiple vibration generation means.

9. The vibrating body massage unit of claim 8 wherein a further, second attachment means comprises artificial briar material on the outer surface of said skull cap which mates with complementary artificial briar material on an outer surface of said vibration generation means.

* * * * *